US006668694B2

(12) United States Patent
Neal et al.

(10) Patent No.: US 6,668,694 B2
(45) Date of Patent: Dec. 30, 2003

(54) DIE CUTTER BLANKET LOCKING ARRANGEMENT

(75) Inventors: Kenneth Ray Neal, Magnolia, TX (US); Stephen Kenneth Warll, Bay Head, NJ (US)

(73) Assignee: Robud, a Florida Partnership, Pine Brook, NJ (US)

( * ) Notice: Subject to any disclaimer, the term of this patent is extended or adjusted under 35 U.S.C. 154(b) by 173 days.

(21) Appl. No.: 09/942,240

(22) Filed: Aug. 29, 2001

(65) Prior Publication Data

US 2003/0041714 A1 Mar. 6, 2003

(51) Int. Cl.[7] ..... B26D 1/00

(52) U.S. Cl. ..... 83/347; 83/348; 83/659; 83/698.31

(58) Field of Search ..... 83/347, 659, 348, 83/709, 326, 398.31, 398.11, 698.42, 698.51, 346; 403/339; 72/192

(56) References Cited

U.S. PATENT DOCUMENTS

| | | | | | |
|---|---|---|---|---|---|
| 3,282,142 | A | * | 11/1966 | Sauer | 83/659 |
| 3,522,754 | A | | 8/1970 | Sauer | |
| 3,577,822 | A | | 5/1971 | Sauer et al. | |
| 3,739,675 | A | * | 6/1973 | Duckett et al. | 83/659 |
| 3,765,329 | A | | 10/1973 | Kirkpatrick et al. | |
| 3,885,486 | A | | 5/1975 | Kirkpatrick et al. | |
| 4,073,207 | A | * | 2/1978 | Kirkpatrick | 83/659 |
| 4,073,208 | A | * | 2/1978 | Kirkpatrick | 83/659 |
| 4,075,918 | A | | 2/1978 | Sauer | |
| 4,289,055 | A | * | 9/1981 | Von Schriltz | 83/659 |
| 4,791,846 | A | | 12/1988 | Kirkpatrick | |
| 4,848,204 | A | | 7/1989 | O'Connor et al. | |
| 4,867,024 | A | | 9/1989 | Cho et al. | |
| 5,076,128 | A | | 12/1991 | O'Connor et al. | |
| 5,078,535 | A | | 1/1992 | Kirkpatrick | |
| 5,515,757 | A | * | 5/1996 | O'Connor et al. | 83/347 |
| 5,720,212 | A | | 2/1998 | Kirkpatrick | |
| 5,758,560 | A | | 6/1998 | Fiscus | |
| 5,906,149 | A | | 5/1999 | Montenegro Criado | |
| 5,916,346 | A | * | 6/1999 | Neal | 83/659 |
| 6,116,135 | A | * | 9/2000 | Wagner | 83/698.42 |
| 6,132,845 | A | * | 10/2000 | Heinzlreiter | 428/156 |
| 6,135,002 | A | | 10/2000 | Neal | |
| 6,435,069 | B1 | * | 8/2002 | Kirkpatrick et al. | 83/698.42 |

* cited by examiner

*Primary Examiner*—Allan N. Shoap
*Assistant Examiner*—Phong Nguyen
(74) *Attorney, Agent, or Firm*—Carella, Byrne, Bain, Gilfillan et al.; John G. Gilfillan, III; William Squire

(57) ABSTRACT

An anvil blanket is molded urethane sheet material and formed with a plurality of interlocking fingers at mating opposing blanket ends and includes a depending projection which mates with a channel in the anvil about which the blanket is wrapped. A urethane insert having a hardness greater than the blanket material is molded embedded in the blanket to form a portion of the fingers and a portion of the projection depending from the fingers. A woven fiberglass fabric provides support for the blanket and which fabric is molded to the blanket. The insert has a durometer greater than that of the blanket to minimize the formation of surface recess defects at the projection which might otherwise occur due to the increased thickness of material at the projection. The insert may have other properties different than that of the blanket material including rebound, modulus, and cut and tear strength among others for resisting the formation of blanket surface defects.

22 Claims, 6 Drawing Sheets

FIG. 3
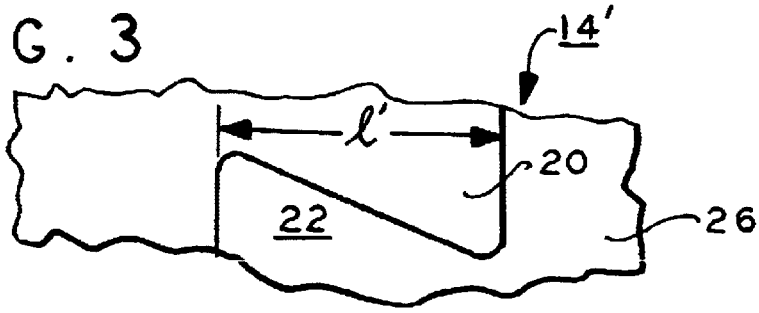
FIG. 4
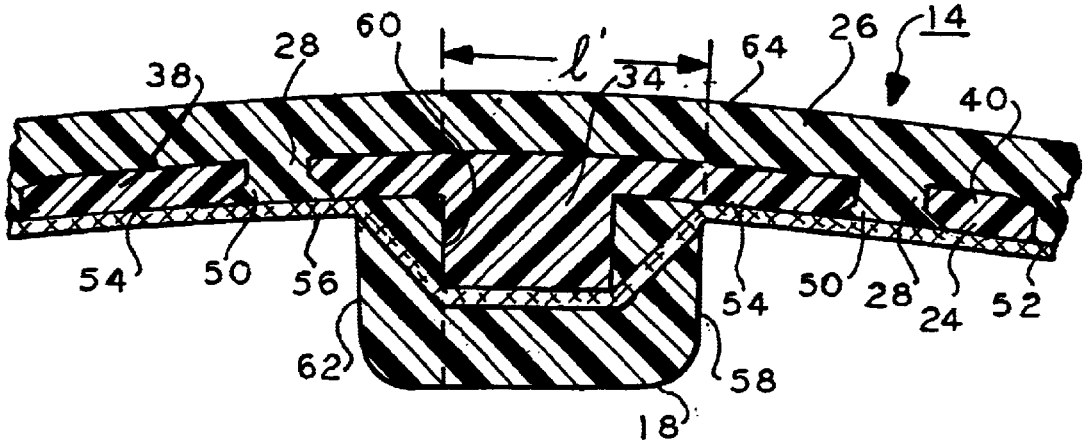
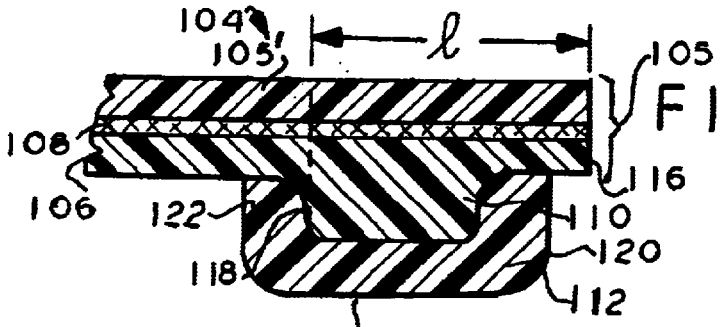
FIG. 5
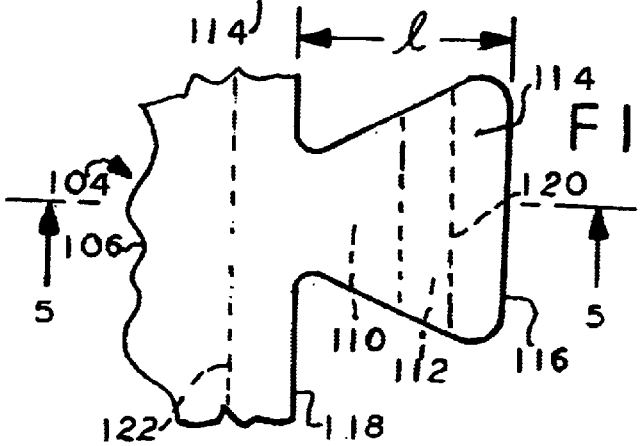
FIG. 6

DIE CUTTER BLANKET LOCKING ARRANGEMENT

This invention relates to die cutter blankets used to cover anvils in a sheet material die cutting apparatus.

Die cutter blankets are thermoset molded urethane material that wrap about steel circular cylindrical anvils. The anvils typically have a channel in the surface thereof extending along the anvil longitudinal axis. The blankets are wrapped about the anvil and have locking projections in some embodiments. The blankets are sheet material with opposing end edges at which the locking projections are located. The ends are complementary and the locking projections engage when inserted into the channel. The locking projections interlock when inserted into the anvil channel, locking the edges to the blanket, locking the blanket to the anvil and preclude the blanket from rotating about the anvil.

U.S. Pat. No. 3,765,329 discloses one aspect of a blanket with such projections. The plastic blanket has a sheet metal inner liner. The locking projections form a two part snap in construction in which a female part receives a male part, the female part depending from the blanket at one end edge thereof with a longitudinal rounded groove and the male part is complementary to the groove and snaps into the groove. The male part may be made of metal. The female part has a metal support. The male and female parts depend from the blanket edge for insertion into the anvil channel.

Other complementary locking structures are shown in U.S. Pat. Nos. 4,848,204, 3,885,486, 4,867,024, 5,078,535 and 5,758,560. All of the above patents use inerlocking complementary depending structures which fit into the anvil channel and cooperate with each other and the anvil channel to lock the blanket ends together.

Another locking arrangement for locking blanket ends together employs interlocking interdigitated fingers which are somewhat dovetail in shape. U.S. Pat. Nos. 4,075,918, 4,791,846 and 3,577,822 disclose this type of interlocking arrangement for use with a die cutter blanket. The interlocking fingers are in the same plane as the blanket sheet material and overlie the anvil. The anvil has a channel. The interlocking fingers, in some embodiments, may overlie the channel. The blanket interlocking finger end portions or other portions of the blanket have a depending projection which fits within the anvil channel to preclude the blanket from rotating relative to the anvil. The blanket is generally of uniform thickness except for the depending projections which add considerable thickness to the blanket at the anvil channel. The blanket is formed of molded urethane and in some embodiments is supported by a woven nylon or fiberglass fabric. The blanket thus comprises two materials, urethane forming the blanket structure and the support woven fabric to which the blanket is molded.

A problem with this construction is that the blanket eventually exhibits a recessed flat portion over the anvil channel during use. This recessed flat portion creates a problem with the product die cut by the apparatus. The die cutters cut into the sheet material being die cut, typically corrugated or pressed cardboard. The cutters also cut somewhat into the blanket. Because of the resiliency of the blanket material the blanket wears uniformly except at the anvil channel and depending projection which results in the recessed flat portion. Because of this recess flat portion, the dies eventually do not cut uniformly through the blank sheet material at this location causing the premature production of poor product. The recessed portion does not permit the dies at this location to cut cleanly through the product sheet material.

The present inventor attributes the recessed flat portion to the greater thickness of the urethane material at the projection region depending into the anvil channel. The present inventor recognizes the source of the problem not heretofore recognized by those of ordinary skill in this industry. The present inventor believes that since the material is resilient, the thicker material at the anvil channel exhibits non-linear increasingly greater resiliency than the sheet blanket material over the rest of the anvil. The present inventor believes that this greater resiliency results in excessive wear of the blanket material at this location as compared to the rest of the blanket surface. That is, the die cutters cut away more material from the blanket at this location than in the rest of the blanket for a given time period of use due to the increased resiliency of the material at the anvil channel region. This problem is only present with the interlocking finger construction which uses solid urethane material at the anvil channel.

According to the present invention, the above problems are minimized by a die cutter blanket for use with an anvil having an axially extending channel in the surface thereof comprising a urethane sheet member blanket having first and second ends, the blanket for wrapping about the anvil. A plurality of complementary interlocking fingers are at the first and second ends for selective interlocking engagement with each other to secure the blanket to the anvil. A first projection depends from and is integral one piece with the sheet member blanket of the same material as the blanket at at least one of the ends for complementary engagement with the channel, the material forming the projection and blanket having a first given property such that the blanket exhibits excessive surface wear at the first projection during use in comparison to the rest of the blanket surface unless otherwise precluded. An insert is embedded in the blanket at at least one of the ends overlying at least the first projection, the insert having a second given property different than the first given property for substantially precluding the excessive wear.

In one aspect the insert is urethane and in another aspect the insert forms a portion of the fingers.

In a further aspect, the insert is sheet material with a second projection depending therefrom forming a portion of the first projection.

In a further aspect, a woven sheet support member is included to which the blanket is secured.

In a further aspect, the insert has a plurality of through bores, a portion of the material of the blanket being embedded in the through bores.

Preferably, the through bores have a chamfered end region.

In a further aspect, the support member has a depending portion extending into the first projection from the plane of the support material.

Preferably, the blanket has a working surface for facing the cutting dies, the support member being uniformly spaced from the working surface of the blanket throughout the blanket.

Preferably the insert is a sheet member. In a further aspect, the sheet member has a projection depending therefrom. Preferably, the sheet member insert is approximately rectangular in plan view having opposing end edges and lateral opposing edges, the projection extending transversely across the sheet member medially the end edges to the opposing lateral edges.

In a further aspect, the blanket first property is a durometer of about 85 and the insert second property is a durometer of about 90

In a still further aspect, the first and second properties are the values of cut and tear resistance of the material wherein the blanket exhibits less resistant to cut and tears than the insert for a given load thereon.

In a further aspect, the first and second properties are the values of rebound of the material wherein the blanket exhibits a higher rebound value than the insert.

In a further aspect, the first and second properties are the modulus values of the material wherein the blanket exhibits a higher modulus than the insert.

IN THE DRAWING

FIG. 3 is a more detailed fragmented view of a portion of an interlock joint of a representative set of fingers of FIG. 2;

FIG. 4 is a sectional elevation view of the assembly of FIG. 2 taken along lines 4—4 according to one embodiment of the present invention;

FIG. 5 is a sectional elevation view of the embodiment of FIG. 6 taken along lines 5—5 of FIG. 6;

FIG. 6 is a fragmented top plan view of an anvil blanket end according to a second embodiment of the present invention;

Figure 1:
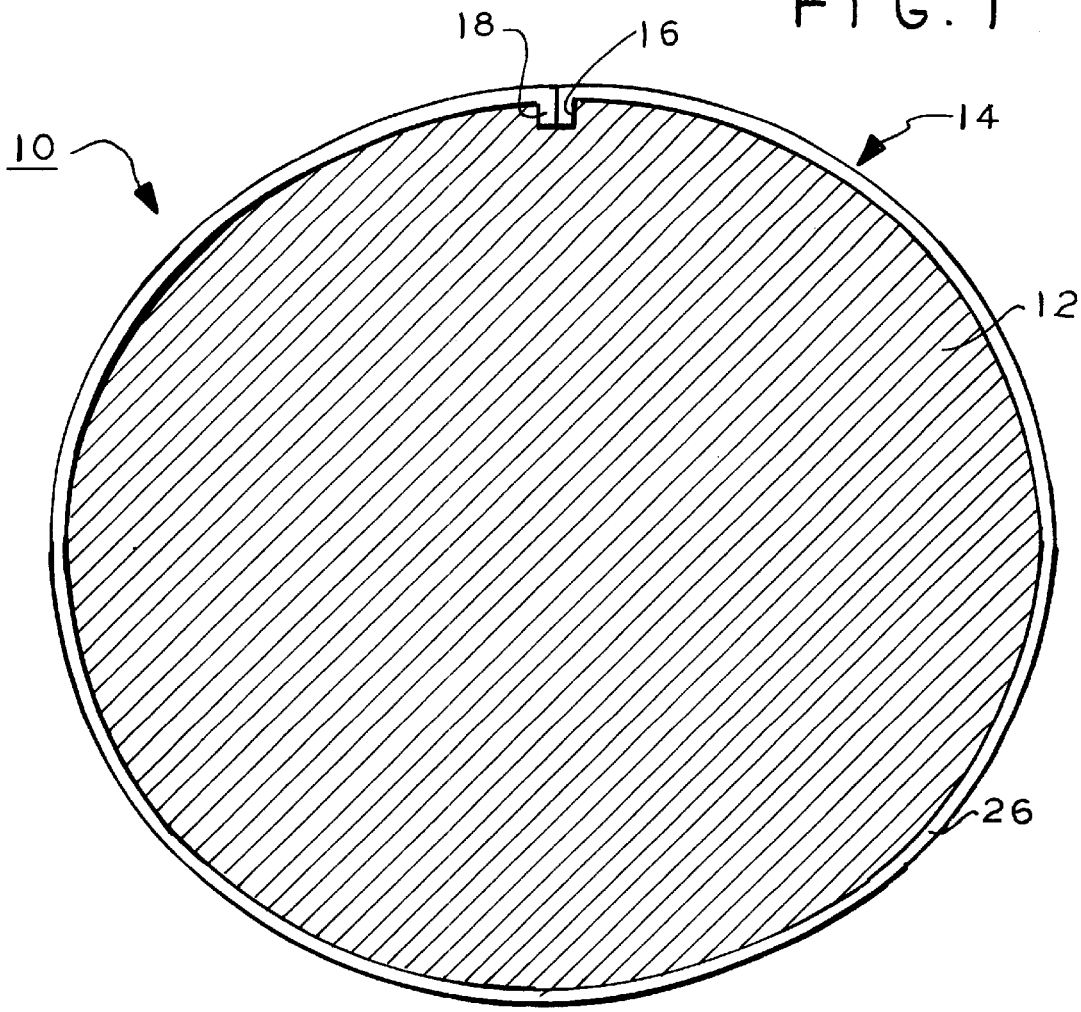
FIG. 1 is an end sectional elevation view of a blanket and anvil assembly according to an embodiment of the present invention.

In FIG. 1, assembly 10 in the present embodiment comprises a steel circular cylindrical anvil 12 and a die cutter blanket assembly 14. The assembly is provided the anvil in an apparatus in which dies cut sheet material moving over the rotating anvil and blanket. The dies penetrate somewhat into the blanket material. The material is resilient, but over a period of time exhibits wear at the die areas impacting the blanket.

The anvil 12 has a channel 16 that extends for the length of the anvil along the anvil axis into the sheet of the drawing. The channel is square or rectangular depending upon the implementation. The blanket assembly 14 has a projection 18 that is complementary with the channel and secures the assembly 14 from rotation relative to the anvil as the anvil rotates during the die cutting process wherein blank sheet material is die cut, such as cardboard and the like. In the prior art, the projection and sheet portion of the blanket are molded of urethane material and typically molded to a support formed by a woven fiberglass or other fibrous material.

Figure 2:
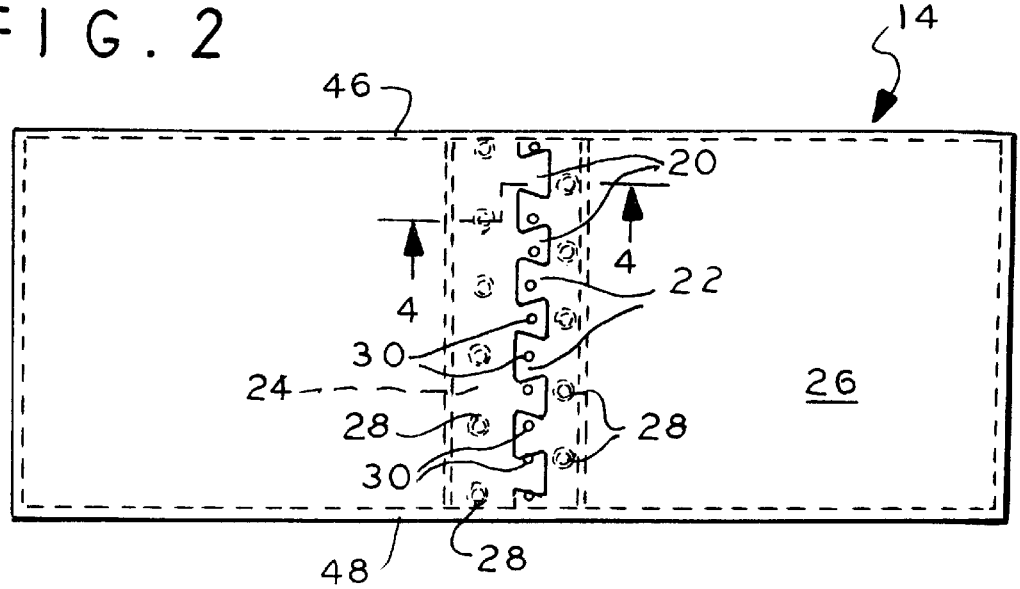
FIG. 2 is a top plan view of the assembly of FIG. 1 showing the interlocking finger joints of the blanket.

In FIG. 2, the blanket assembly 14 is formed with a plurality of interlocking fingers 20 and 22 which are complementary configured dovetail shapes An insert 24 of molded urethane material is embedded in the blanket 26 of assembly 14.

Figure 9:
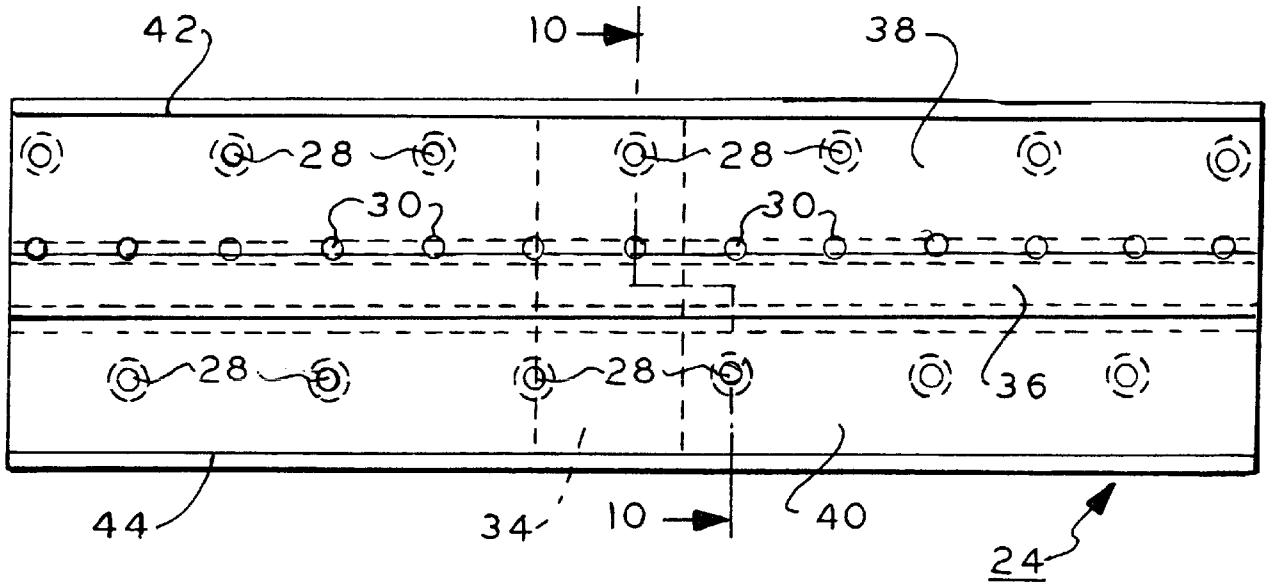
FIG. 9 is a top plan view of a blanket insert according to one embodiment.
Figure 10:
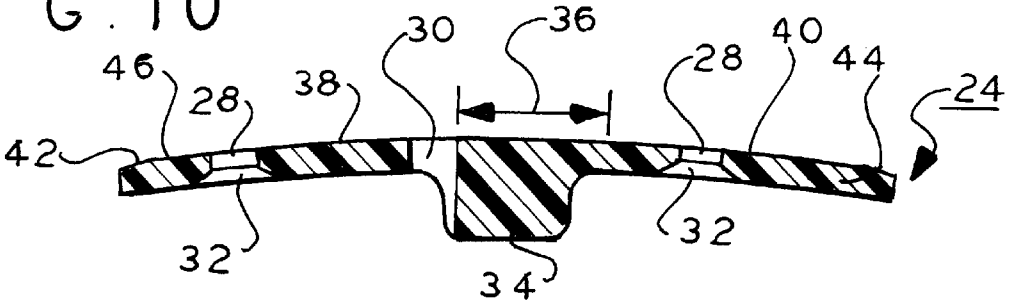
FIG. 10 is a sectional elevation of the embodiment of FIG. 9 taken along lines 10—10.

In FIGS. 9 and 10, insert 24 of a first embodiment is a molded rectangular shape as seen in FIG. 9. The insert 24 has a plurality of through bores 28 formed therein. The insert 24 has a second plurality of through bores 30. Bores 28 are countersunk with a tapered portion 32, FIG. 10. The bores 30 are uniform throughout.

The insert 24 is formed with a depending projection 34. The bores 30 penetrate through a portion of the projection 34. The rest of the insert 24 extending from the projection 34 in opposite directions therefrom are of substantially uniform thickness sheet material. The insert has a flat surface at central region 36 and has two sheet material mirror image portions 38, 40 of the same thickness and which are inclined at about 6° from the plane of region 36. Two edge regions 42, 44 are chamfered somewhat on the top surfaces 46. The inclination of the portions The insert 24 inclined portions 38, 40 and region 36 approximate the curvature of the blanket when the blanket is secured to the anvil 12. The insert 24 length dimension from left to right, FIG. 9, extends transversely across the blanket 26. The insert has a durometer of about 90 shore hardness and the blanket has a durometer of about 85 shore hardness. However these values are nominal and may vary in the range of about +/−2 durometer. The hardness of the insert however is always greater than that of the blanket material regardless the hardness values which may vary somewhat from the above values. The insert is thus harder than the blanket, although both are made of thermoset molded urethane material. The reason for this difference in properties will be explained below.

The insert may differ from the blanket in respect of other properties according to a given implementation. Such properties include cut and tear resistance, i.e., the ability of the material to resist cutting and tearing in response to cuts formed by an edge and tearing in response to a tearing force, rebound, in which the ability of the material returns to its acquiescent position in response to deformation forces and is a measure of the rate of return, and the material modulus, material elongation in response to a tensile load, i.e., the amount of elongation for a given load. Any or any combination of these properties may contribute to defects in the blanket during use at the projection region located in the anvil channel as will be explained below.

In FIG. 4, the insert 24 is shown molded embedded into the blanket 26 material. The insert extends across the blanket within about ¼ inch (6.4 mm) from the blanket edges 46, 48, FIG. 2. The bores 28 are filled with the blanket material during the molding process. The chamfered portions 32 (FIG. 10) fill with the blanket material also and lock the insert to the blanket due to the flanges 50 of blanket material formed by the chamfered portions. The bores 30 (not shown in FIG. 4) secure the insert 24 projection 34 to the blanket and do not have similar flanges. The insert 24 is embedded in the blanket 26 at the blanket lower surface 52 and the two materials may have coplanar surfaces. The insert 24, portions 38, and 40, and bottom surfaces 54 are thus coplanar with the blanket lower surface 52.

A conventional woven sheet fiberglass fabric 56 or other fabric as used in the industry is molded to the blanket 26 and to the insert 24 which are molded together as the blanket is molded. The fabric 56 is somewhat U-shaped at the projection 18 and depends into the projection as shown in FIG. 4, below and adjacent to the insert 24 projection 34.

The blanket assembly 14 is initially formed as a molded circular cylinder with the insert 24 embedded therein. The fingers 20 and 22 in the cylinder are then formed, FIGS. 2 and 3, by die cutting the cylinder (not shown). This is a typical commercially known process for forming such fingers in this art. In FIG. 3, fingers 20 and 22 have a length l'. The position of the fingers 20 and 22 is shown in FIG. 4 by the dimension l'. The tips of fingers 20 extend from a side 58 of projection 18 to a side 60 of the insert 24 projection 34 adjacent to the side 62 of projection 18. Thus, a major portion of projection 18 forms the fingers and the entire portion of the insert projection 34 is within projection 18.

In operation, the blanket assembly 14 is attached to the anvil 12 in conventional fashion by insertion of the projection 18 into the anvil channel 16 and interlocking the fingers 20 and 22. However, the projection 18 has a large mass of insert projection 34 therein. The mass of the insert projection has a greater hardness than that of the blanket material projection 18. The resiliency of the urethane material is non-linear, which means the greater the thickness the greater the resiliency in non-linear increasing fashion. The thicker material thus exhibits an increasingly greater resilience than a thinner material of the same properties.

The harder insert material resists the tendency of the blanket surface 64, FIG. 4, to deflect for a given cutter load as compared to a blanket formed solely of one type of urethane in the projection and thus provides a support at this location for the blanket. It is believed that in the prior art the thicker projection permits the surface to deflect more at the projection region than at the non-projection regions for a given die cutter load. This greater deflection results in the formation of an undesirable flat recess in the projection and anvil channel region discussed in the introductory portion. That is, excess wear of the blanket surface 64 occurs in the anvil-projection region than in the remaining blanket surface region due to the greater deflection of the surface in response to impact of the cutter dies.

By reinforcing the projection 18 region of greater urethane thickness with a stiffer harder material formed by the insert 24 or of other different enhancing property, the surface 64 deflection is normalized to that which occurs at the rest of the surface 64 beyond the anvil channel region and beyond the region of the projection 18. This normalized deflection thus results in more uniform wear of the surface 64. This minimizes the occurrence of defects in the die cut sheets of cardboard material and thus provides longer life of the blanket. This reduces the cost of blanket replacements and of rejected poor product formed by the cutting apparatus, providing lower cost to the product.

The various different properties of the insert mentioned above may also contribute to minimizing the wear of the blanket surface at the thicker projection region in accordance with a given implementation. The various properties other than hardness as noted above herein may in certain cases be a primary cause of surface defects in the blanket due to wear. The effect of the different properties is determined empirically in a case by case basis.

Figure 11:
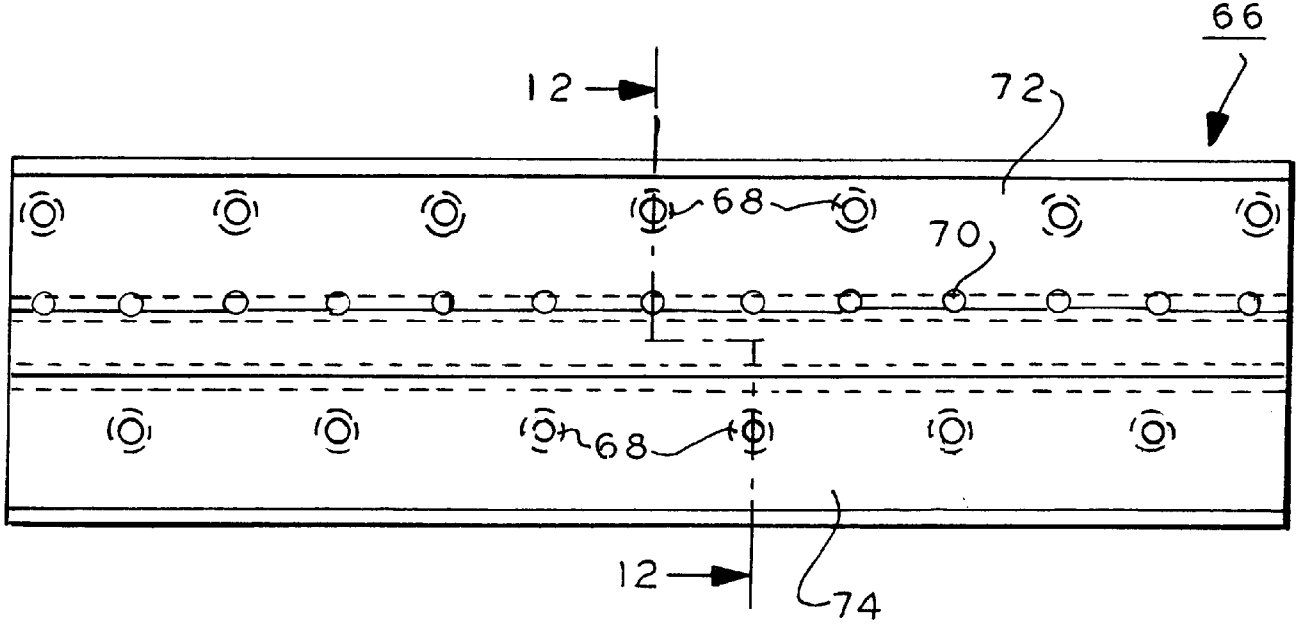
FIG. 11 is a top plan view of a blanket insert according to a second embodiment.
Figure 12:
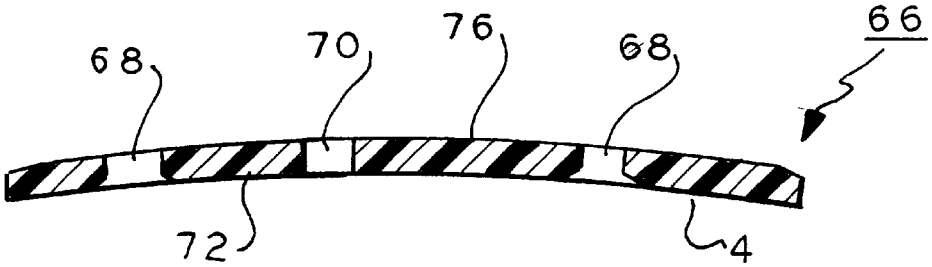
FIG. 12 is a sectional elevation of the embodiment of FIG. 11 taken along lines 12—12.

FIGS. 11 and 12 shown an insert 66 of a different configuration. Insert 66 is substantially the same as insert 24 but has no projection. Insert 66 has chamfered through bores 68 and non-chamfered through bores 70. Bores 70 over lie the projection region of the mating blanket and thus the anvil channel. The bores 68 are located in section portions 72 and 74 of the insert. The upper surface 76 is shaped the same as that of the insert 24 described above. The insert 66 has the same properties as described above for insert 24. The insert 66 is rectangular in plan view in FIG. 11. It is somewhat angular to accommodate the curvature of the blanket as described above for insert 24. However, insert 66 is substantially sheet material notwithstanding its somewhat bent configuration.

In FIGS. 5 and 6, in a further embodiment, blanket assembly 104 comprises a blanket sheet 105 in which there is embedded an insert 106 and a woven fabric layer 108. The sheet 105 is molded with a depending projection 112. The sheet 105 has a top layer 105' over and abutting the fabric layer 108, which is over and abutting the insert 106. The insert 106 has a depending projection 110 embedded in the projection 112. The insert 106 serves the same function as the insert 24. FIG. 4. The assembly 104 has fingers 114 defined by length l. The finger 114 shown terminates at extended crest edge 116. The finger 114 terminates at root 118. Edge 116 extends beyond the surface 120 of the projection 112. The projection 112 has a side surface 122.

Figure 7:
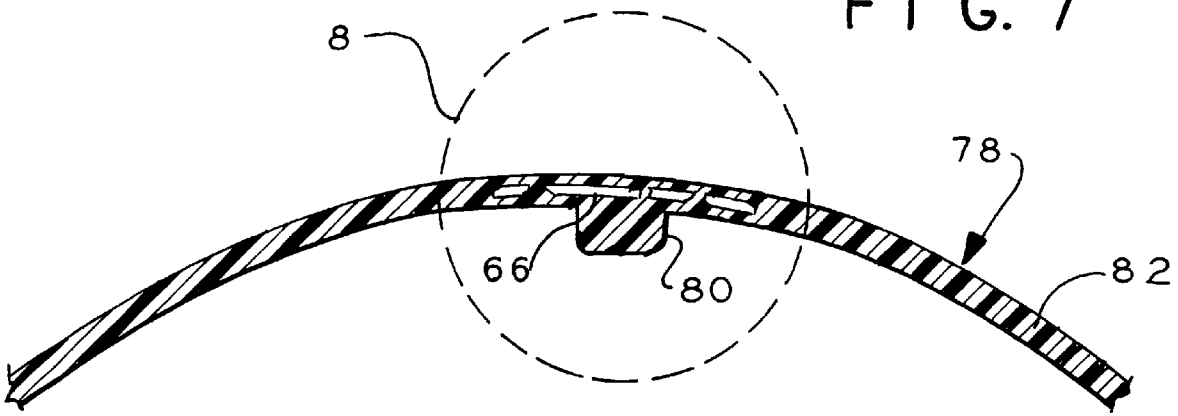
FIG. 7 is an end sectional fragmented view of a blanket locking portion according to a third embodiment.
Figure 8:
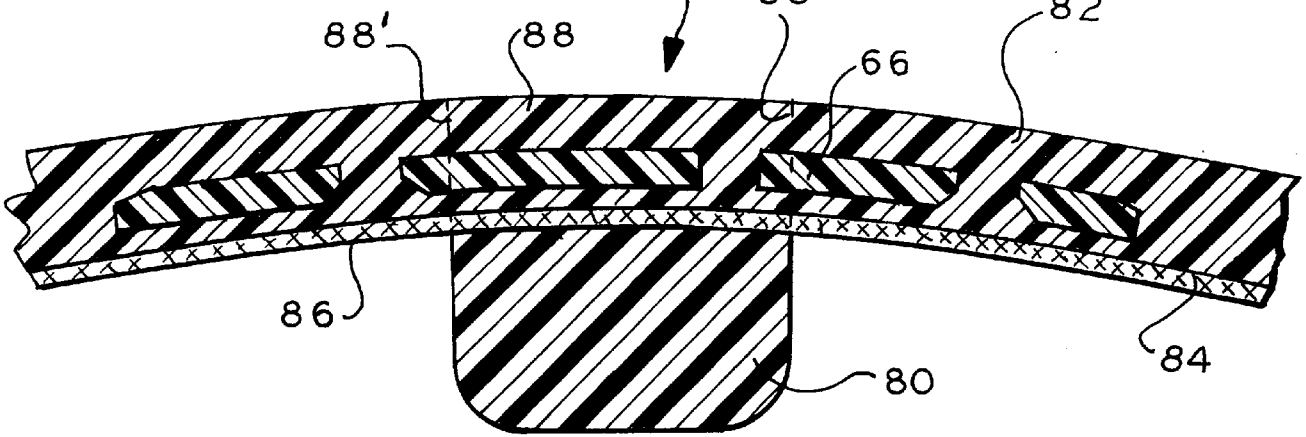
FIG. 8 is a more detailed view of the embodiment of FIG. 7 taken at region 8.

In FIG. 7, blanket assembly 78 includes insert 66 located somewhat symmetrically with projection 80 of blanket 82. In FIG. 8, the insert 66 is substantially coplanar with the blanket 82 and embedded therein. The insert 66 is adjacent to the lower surface 84 of the blanket and is molded integrally therewith. A woven fiberglass support 86 is molded or otherwise bonded to the lower surface of the blanket 82. In this case the support extends coextensive across the projection 80 of the blanket 82 which projection depends from the fabric support 86. The fingers 88 (represented by dashed lines 88') are formed in the region of the projection 80 and overly the projection 80. In this embodiment, the properties of the insert are of such value that the insert need not depend into the projection 80 in order to minimize surface defects in the blanket 82. As in the embodiment of FIGS. 4 and 9, the insert 66 and blanket 82 are molded as a circular cylinder initially. Later, the fingers 88 are die cut formed in the molded cylinder blanket assembly 78 as in commercially known processes.

Figure 13:
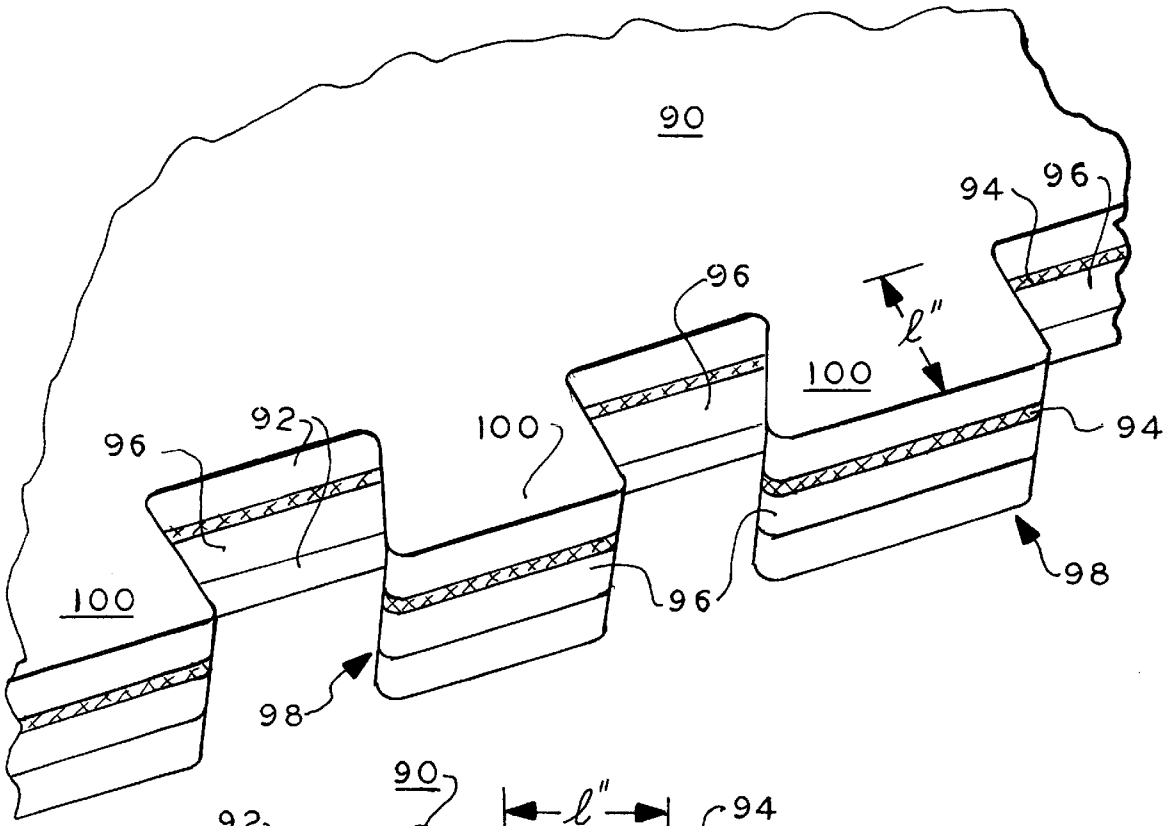
FIG. 13 is an isometric view of the locking fingers of the embodiment of FIGS. 5 and 6.
Figure 14:
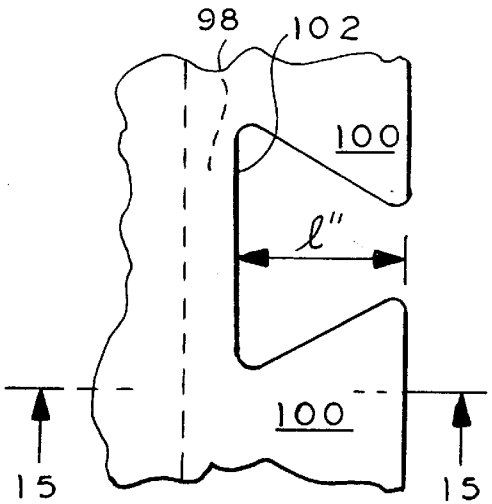
FIG. 14 is a plan view of the end interlocking finger portion of a blanket according to a further embodiment.
Figure 15:
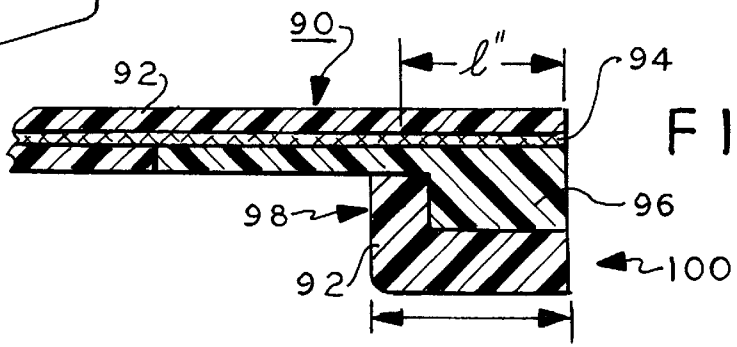
FIG. 15 is a sectional view of the embodiment of FIG. 14 taken along lines 15—15.

In FIGS. 13–15, a further embodiment is shown. Blanket assembly 90 comprises a blanket 92 of molded urethane supported on a fiberglass woven support 94. A molded urethane of harder material insert 96 is bonded to the underside of the woven support 94. Insert 96 is of the shape and configuration of insert 24, FIGS. 9 and 10. The difference between the embodiment of FIG. 4 and that of FIG. 13 is that the woven fabric support 94 is molded in the interior of the blanket 92 as best seen in FIG. 15, rather than at the bottom surface as shown in the embodiments of FIGS. 4 and 8. The projections 98 thus comprise the blanket material on the top surface and at the bottom surface of the fingers 100. The fabric support 94 is embedded in the blanket material. The insert 96 is embedded beneath the fabric support and above the blanket material in the fingers 100. The fingers 100 have a length l". The fingers 100 of one blanket end terminate at their roots 102 in the projection 98 region as best seen in FIG. 14. In this way the fingers are formed entirely of the projection 98 layers. The fingers of the mating blanket mirror image end may be constructed similarly.

It will occur to one of ordinary skill in this art that various modifications may be made to the disclosed embodiment without departing from the spirit and scope of the invention. The disclosed embodiment is for illustration and not limitation. The invention is defined by the appended claims.

What is claimed is:

1. A die cutter blanket for use with an anvil having an axially extending channel in the surface thereof comprising:

a urethane sheet member blanket having first and second ends, the blanket for wrapping about the anvil;

a plurality of complementary interlocking fingers at the first and second ends for selective interlocking engagement with each other to secure the blanket to the anvil;

a first projection depending from and integral one piece with the sheet member blanket of the same material as the blanket at at least one of the ends for complementary engagement with the channel, the material forming the projection and blanket having a first given property such that the blanket exhibits excessive surface wear at said first projection during use in comparison to the rest of the blanket surface unless otherwise precluded; and an insert embedded in said blanket at at least one of said ends overlying at least said first projection, the insert having a second given property different than the first given property for substantially precluding said excessive wear.

2. The blanket of claim 1 wherein the insert is urethane.

3. The blanket of claim 1 wherein the insert forms a portion of said fingers.

4. The blanket of claim 1 wherein the insert is sheet material with a second projection depending therefrom forming a portion of the first projection.

5. The blanket of claim 4 wherein the insert has a plurality of through bores, a portion of the material of the blanket being embedded in the through bores.

6. The blank of claim 5 wherein the through bores have a chamfered end region.

7. The blanket of claim 1 including a woven sheet support member to which the blanket is secured.

8. The blanket of claim 7 wherein the support member has a depending portion extending into the first projection from the plane of the support material.

9. The blanket of claim 7 wherein the blanket has a working surface for facing the cutting dies, the support member being uniformly spaced from the working surface of the blanket throughout the blanket.

10. The blanket of claim 1 wherein the insert is a sheet member.

11. The blanket of claim 10 wherein the sheet member has a projection depending therefrom.

12. The blanket of claim 11 wherein the sheet member insert is approximately rectangular in plan view having opposing end edges and lateral opposing edges, the projection extending transversely across the sheet member medially the end edges to the opposing lateral edges.

13. The blanket of claim 1 wherein the blanket first property is a durometer of about 85 and the insert second property is a durometer of about 90.

14. The blanket of claim 1 wherein the first and second properties are the values of cut and tear resistance of the material wherein the blanket exhibits less resistant to cut and tears than the insert for a given load thereon.

15. The blanket of claim 1 wherein the first and second properties are the values of rebound of the material wherein the blanket exhibits a higher rebound value than the insert.

16. The blanket of claim 1 wherein the first and second properties are the modulus values of the material wherein the blanket exhibits a higher modulus than the insert.

17. A die cutter blanket for use with a cylindrical anvil having an axially extending channel in the surface thereof comprising:

a urethane sheet member blanket having first and second ends, the blanket for wrapping about the anvil;

a plurality of complementary interlocking fingers at said first and second ends for selective interlocking engagement with each other to secure the blanket to the anvil;

a first projection depending from and integral one piece with the sheet member blanket of the same material as the blanket at at least one of said ends for complementary engagement with said channel, the material forming the projection and blanket having a first given property such that the blanket exhibits excessive surface wear at said first projection in comparison to the rest of the blanket surface during use unless otherwise precluded; and a molded urethane sheet insert embedded in said blanket at at least one of said ends overlying at least said first projection, the insert having a second given property different than the first given property for substantially precluding said excessive wear.

18. The blanket of claim 17 wherein the insert has a plurality of through bores in which a portion of the blanket material is embedded.

19. The blanket of claim 17 wherein the property is any one or more selected from the group consisting of hardness, modulus, rebound or cut and tear resistance.

20. The blanket of claim 17 wherein the insert has a portion forming a portion of the first projection.

21. A die cutter blanket for use with a cylindrical anvil having an axially extending channel in the surface thereof comprising:

a molded urethane sheet member blanket having first and second ends, the blanket for wrapping about the anvil;

a plurality of complementary interlocking fingers at said first and second ends for selective interlocking engagement with each other to secure the blanket to the anvil;

a first projection depending from and integral one piece with the sheet member blanket of the same material as the blanket at at least one of said ends for complementary engagement with said channel, the material forming the first projection and blanket having a first given property such that the blanket exhibits excessive surface wear at said first projection during use in comparison to the remaining blanket surface unless otherwise precluded; and a molded urethane sheet insert embedded in said blanket at at least one of said ends included in said fingers and in at least said first projection, the insert having a second given property different than the first given property for substantially precluding said excessive wear, the insert having a plurality of through bores in which a portion of the blanket material is embedded.

22. The blanket of claim 21 wherein the insert has a sheet material portion extending from the fingers at each of the first and second ends.

* * * * *